US005288601A

United States Patent [19]

Greener et al.

[11] Patent Number: 5,288,601

[45] Date of Patent: Feb. 22, 1994

[54] LIGHT SENSITIVE SILVER HALIDE ELEMENT HAVING PHOTOGRAPHIC FILM BASE WITH IMPROVED CURL STABILITY

[75] Inventors: Jehuda Greener; James M. Pearson, both of Rochester, N.Y.

[73] Assignee: Eastman Kodak Company, Rochester, N.Y.

[21] Appl. No.: 95,137

[22] Filed: Jul. 21, 1993

[51] Int. Cl.[5] ..... G03C 1/76

[52] U.S. Cl. ..... 430/533; 430/523; 428/215; 428/220; 428/332; 428/336; 428/380; 428/383

[58] Field of Search ..... 430/523, 533; 428/215, 428/220, 332, 336, 380, 383

[56] References Cited

U.S. PATENT DOCUMENTS

| | | | |
|---|---|---|---|
| 4,252,885 | 2/1981 | McGrail et al. | 430/533 |
| 4,304,831 | 12/1981 | McGrail et al. | 430/533 |
| 4,585,687 | 4/1986 | Posey et al. | 430/533 |
| 4,883,706 | 11/1989 | Grosjean | 428/215 |
| 5,138,024 | 8/1992 | Brozek | 528/272 |

FOREIGN PATENT DOCUMENTS

| | | |
|---|---|---|
| 0496346A1 | 7/2992 | European Pat. Off. . |
| 4-235036 | 8/1992 | Japan . |

*Primary Examiner*—Jack P. Brammer
*Attorney, Agent, or Firm*—Robert A. Gerlach

[57] ABSTRACT

The invention contemplates a light-sensitive silver halide photographic element having at least one silver halide containing emulsion layer on a film base, the film base being a coextruded laminate having a first layer and a second layer, the first layer being a polyester of an aromatic dicarboxylic acid or a dialkyl ester thereof and an alkylene glycol adjacent to the emulsion layer, the second layer being a polyester having a humidity expansion coefficient greater than $5\times10^{-5}$ $$\frac{1}{\%\ RH},$$

(RH is relative humidity) and a Young's modulus at 50% relative humidity greater than 300 kPSI.

9 Claims, No Drawings

LIGHT SENSITIVE SILVER HALIDE ELEMENT HAVING PHOTOGRAPHIC FILM BASE WITH IMPROVED CURL STABILITY

FIELD OF THE INVENTION

This invention relates to photographic elements and more particularly to photographic elements having improved curl stability and to an improved film base upon which the photographic element is built.

BACKGROUND OF THE INVENTION

Film curl is of critical importance in the handling and processing of photographic films. Because of the high humidity sensitivity of emulsion layers and the large differences in humidity-expansion coefficient (HEC) among the various layers in a typical photographic film, the curvature of the film is particularly sensitive to variations in relative humidity (RH). This problem is especially acute in films wherein a polyester such as polyethylene terephthalate is used as the film base because such films have a very low humidity-expansion coefficient, and it becomes more severe for thinner films.

It is desired to make photographic elements thinner in order to enable more pictures to be taken on a film housed in cartridges currently utilized or to provide a film cartridge smaller in size to achieve the number of exposures equal to that presently available. This reduction in the thickness of the photographic elements would in turn permit the manufacture of smaller cameras. While cellulose triacetate film base has been for a long time the primary material of choice, it does not have the physical strength characteristics necessary in order to reduce the thickness of the support upon which photographic emulsion layers are applied. Polyethylene terephthalate, on the other hand, while it has the necessary mechanical characteristics suffers from problems with respect to curl at various relative humidity conditions.

One technique known in the art to control curl is to apply a pelloid (gelatin) layer to the side of the film base opposite to the side the photographic emulsion is applied. This is disadvantageous because the pelloid layer can not be applied during the manufacture of the film base, thus requiring a separate coating operation which greatly increases the capital and operating costs.

SUMMARY OF THE INVENTION

The invention contemplates a light-sensitive silver halide photographic element having at least one silver halide containing emulsion layer on a film base, the film base being a coextruded laminate having a first layer and a second layer, the first layer being a polyester of an aromatic dicarboxylic acid or a dialkyl ester thereof and an alkylene glycol adjacent to the emulsion layer, the second layer being a polyester having a humidity expansion coefficient greater than $5\times10^{-5}$ $$\frac{1}{\%\,RH},$$

(RH is relative humidity) and a Young's modulus at 50% relative humidity greater than 300 kPSI. The thickness of the second layer is defined by the formula;

$$0.3\,h_2^0 < h_2 < 1.2\,h_2^0 \qquad \text{I}$$

where $h_2^0$ is the thickness of the second layer to obtain zero curl and is determined by formula $$h_2^0 = 0.5\left(-\frac{b}{a} + \sqrt{\left(\frac{b}{a}\right)^2 - 4\frac{c}{a}}\right) \qquad \text{II}$$

where the values a, b and c are obtained by the following formulas III, IV and V respectively;

$$a = \phi E'_2 - E'_e h_e - E'_1 h_1 \qquad \text{III}$$

$$b = \phi(h_e + h_1)E'_2 + \phi h_1 E'_2 - (h_e + h_1)h_e E'_e - h_1(E'_e h_e + E'_1 h_1) \qquad \text{IV}$$

$$c = \phi(h_e + h_1)h_1 E'_1 \qquad \text{V}$$

$\phi$ in the above formulas is determined by the following formula VI $$\phi = \frac{E'_e h_e(\alpha_e - \alpha_1)}{E'_2(\alpha_e - \alpha_2)} \qquad \text{VI}$$

where $E'_e$, $E'_1$ and $E'_2$ are determined by the formula $$E'_i = \frac{E_i}{1 - \nu_i^2} \qquad \text{VII}$$

where i is layer 1, 2 or e respectively and $\nu_i$ is the Poisson's ratio of layer i (layer 1, 2 or e, respectively) and where $h_e$, $E_e$ and $\alpha_e$ are the thickness, Young's modulus and HEC, respectively, of the emulsion layer;

$h_1$ $E_1$ and $\alpha_1$ are the thickness, Young's modulus and HEC respectively of the first layer of the film base; and $h_2$, $E_2$ and $\alpha_2$ are the thickness, Young's modulus and HEC respectively of the second layer of the film base.

Preferably $h_2$ is defined by the formula $$0.5h_2^0 < h_2 < h_2^0$$

DESCRIPTION OF THE PREFERRED EMBODIMENTS

In accordance with the invention, the thickness of the second layer of the film base is determined by utilizing formula I. $h_2^0$ is calculated from formula II and the values a, b and c from formulas III, IV and V respectively. The values $E'_1$ and $E'_2$ and $E'_e$ are values for each layer determined from the Young's modulus and Poisson's ratio of each layer. The relationship is set forth in formula VII. By substituting the values for Young's modulus and Poisson's ratio into this formula for each layer 1,2 or the value of $E'_1$ and $E'_2$ and $E'_e$ are readily determined and are used in formulas III–VI. To determine the values a, b and c, the value of $\phi$ is first determined utilizing formula VI and the value thus obtained is substituted into formulas III, IV and V to determine the values a, b and c, which are then substituted into formula II in order to determine the $h_2^0$ which is the thickness of a second layer to give zero curl for the photographic film. This value is used in formula I to define a range for the thickness of the second layer. The values for thickness, Young's modulus and HEC for the emulsion layers are determined as follows: The emulsion thickness is obtained by measuring the total thickness of all of the emulsion layers that form the photographic element on the side of the film base adjacent to the first layer thereof. For example, if the photographic element is a black and white element, the total thickness of the emulsion layers containing the silver halide salts are measured and this value is substituted for he in Formulas III–VI. Should the photographic element be a color film, the total thickness of all of the emulsion layers is measured and substituted into formulas III–VI. Thicknesses in all cases are measured in micrometers.

The Young's modulus, of the various layers is measured on a Sintech tensile tester based on a standard protocol described in ASTM D882 ("Standard Test Methods for Tensile Properties of Thin Plastic Sheeting"). The samples are cut 15mm ×6 in. (4 in. gauge length) and preconditioned at 21° C./50% RH. The testing is done at the same condition and a strain rate of 50%/min.

The humidity expansion coefficient (HEC) of the various layers is measured with a pin gauge based on a standard method described in ANSI PH1.32 ("Methods for Determining the Dimensional Change Characteristics of Photographic Films and Papers"). According to this method the film sample is cut 35mm ×12 in. (approx.) with two pairs of pin perforations punched at its ends. The sample length is measured after equilibration at 50, 15 and 50% RH, respectively, at 21° C. The HEC is determined from the dimensional change on rehumidifying (15 to 50% RH) the film.

Poisson's ratio is the ratio of strain of the particular layer in question in the stretched direction divided by the strain in the transverse direction. Poisson's ratio is measured for the emulsion layer, the first layer and the second layer. The measurements of these properties are done on an extruded film of the first layer only, the second layer only and the emulsion layers. The emulsion films are prepared by carefully peeling the coated layer from an unsubbed support. The units for Young's modulus are kPSI and those for HEC are 1/% RH.

The thickness of the first layer depends upon the overall desired thickness of the film base to be employed in accordance with the invention. For example, should it be desired to utilize a total film base thickness of 100 micrometers, $h_2$ is computed from formulas I–V while $h_1 = 100 - h_2$.

The values, thus determined, are first substituted into formula VI and the value of $\phi$ calculated therefrom. This value of $\phi$ is then substituted into formulas III, IV and V together with the appropriate values for the thickness and modulus and the values of a, b and c then determined. As described above, these values for a, b and c are next substituted into formula II and a value of the thickness of the second layer to achieve zero curvature is determined accordingly. Formula I establishes the range of layer 2 to achieve satisfactory performance.

The polyester of the first layer can be any suitable polyester of an aromatic dicarboxylic acid or a dialkyl ester thereof and an alkylene glycol, the polyester having a modulus more than about 500 kPSI and a humidity expansion coefficient less than about $5 \times 10^{-5} \times$ $$\frac{1}{\% RH}.$$

Any suitable aromatic dicarboxylic acid or dialkyl ester thereof may be employed in the preparation of the polyester of the first layer such as terephthalic acid, dimethyl terephthalate, diethyl terephthalate, di-n-propyl terephthalate, di-isopropyl terephthalate, isophthalic acid, dimethyl isophthalate, diethyl isophthalate, di-n-propyl isophthalate, diisopropyl isophthalate, 2,5-naphthalenedicarboxylic acid, 2,5-dimethylnapthalenedicarboxylate, 2,5-diethylnaphthalenedicarboxylate, 2,6 naphthalenedicarboxylic acid, 2,6 dimethylnaphthalene dicarboxylate, 2,6-di-n-propyl naphthalenedicarboxylate, 2,7 naphthalene dicarboxylic acid, 2,7 dimethylnaphthalenedicarboxylate, 2,7-diisopropylnaphthalenedicarboxyalate, diphenyl dicarboxylic acid, and the like. Any suitable glycol may be used to prepare the polyester of layer 1, such as, for example, ethylene glycol, 1,3-propane diol, 1,4-butane diol, neopentyl glycol, 1,4-cyclohexane dimethanol, and the like. Mixtures of acids, dialkyl esters of the aromatic diacids and mixtures of the glycols mentioned above may be employed to prepare the polyester that forms the first layer in accordance with this invention. It is preferred to prepare the first layer in accordance with this invention from polyethylene terephthalate or polyethylene naphthalate.

For the second layer of the film base, any suitable polyester having a humidity expansion coefficient greater than $5 \times 10^{-5} \times$ $$\frac{1}{\% RH},$$

and a Young's modulus at 50% relative humidity greater than 300 kPSI may be employed such as those prepared from an aromatic dicarboxylic acid or dialkyl ester thereof, an alkylene glycol, a salt of a sulfonic acid-substituted aromatic dicarboxylate and a polyethylene glycol of low molecular weight. Any of the aromatic dicarboxylic acids or alkyl esters thereof, mentioned above, with respect to the polyester of the first layer and any of the alkylene glycols mentioned above with respect to the first layer may be employed in the preparation of the polyester of the second layer. In addition to these two types of ingredients, a salt of a sulfoaromatic diacid or diester such as, for example, 2-sodium sulfoterephthalic acid, 4-sodium sulfophthalic acid, 5-(4-sodium sulfophenoxy) isophthalic acid, 4-sodium sulfo-2,6-naphthalenedicarboxylic acid, 5-sodium sulfoisophthalic acid or the dimethyl ester thereof and the like. Of these, it is preferred to use 5-sodium sulfoisophthalic acid with a dimethyl ester thereof. Also, useful are the corresponding salt of metals other than sodium, for example, other alkali metals such as, potassium, lithium and cesium.

The poly (ethylene glycol) used in the methods of this invention is a low molecular weight polyethylene glycol having a number average molecular weight from about 300 to about 2000. The preferred molecular weight range is from about 300 to about 1600 and most preferably is from about 300 to 500. The modified polyesters described in U.S. Pat. No. 5,138,024 issued to Brozek et al Aug. 11, 1992 and signed to the same assignee as that of the immediate application are preferred for use as the second layer in accordance with this invention. This patent is wholly incorporated herein by reference. The materials of U.S. Pat. Nos. 4,217,441 and 4,241,170 may also be used for the second layer in accordance with this invention.

The film base having a first layer and a second layer is prepared in a manner similar to that employed conventionally in the preparation of polyethylene terephthalate photographic film base. The polyester resin of the first layer and the polyester of the second layer are individually plasticated in two different extruders and then fed to a coextrusion die which produces a two-layered sheet. The resins of the two layers must be coextrudable, ie, the melt viscosities must be comparable under similar temperatures. The relative thicknesses of the two layers formed at the extrusion die are adjusted by changing the die lip dimensions and relative throughputs of the two extruders. The thickness of the first layer is dependent upon the desired total thickness of the finished photographic film base and the thickness of the second layer is determined from the formula set forth above. One skilled in the art knowing the desired final specifications of the film base can estimate the thicknesses of the cast material employing the formula VIII $$h_{ci} \approx h_i(\lambda_{MD} \times \lambda_{TD})$$

where $h_i$ and $h_{ci}$ are the final film and cast sheet thicknesses for layer i (1 or 2), and $\lambda_{MD}$ and $\lambda_{TD}$ are the draw ratios in the machine and transverse directions, respectively. The first layer and second layer may be separated by other coextruded layers, such as, tie layers to improve adhesion and the like.

After the laminate of film comprised of the first layer and the second layer exits the die, it is cast onto a casting wheel at a low temperature of from about 30° to about 70° C. and then biaxially oriented by passing through a drafting zone followed by a tentering zone where the laminate film is stretched in each direction from about 2.5 to about 4 times the original dimension as cast. The temperature in the drafting and tentering zones varies from about 90° to about 110° C. depending upon the material in layer 1 and 2. Finally, the oriented film is heat-set at a temperature of from about 140° C. to about 220° C. in order to achieve good dimensional stability.

The thus formed laminate film base is treated with a U-coat in order to enable tight adhesion of the emulsion layers to the first layer of the film base. Suitable U-coats include any of those disclosed in U.S. Pat. Nos., 2,627,088; 3,501,301; 4,689,359; 4,857,396; 4,363,872; 4,087,574 which are incorporated herein by reference. The U-coat may be applied at any suitable location or station in the preparation of the film.

Photographic elements in accordance with the invention generally comprise at least one light-sensitive layer, such as a silver halide emulsion layer. The light-sensitive layer or layers are applied to the U-coated first layer of the photographic film base. This emulsion layer may be sensitized to a particular spectrum of radiation with, for example, a sensitizing dye, as is known in the art. Additional light-sensitive layers may be sensitized to other portions of the spectrum. The light sensitive layers may contain or have associated therewith dye-forming compounds or couplers. For example, a red-sensitive emulsion would generally have a cyan coupler associated therewith, a green-sensitive emulsion would be associated with a magenta coupler, and a blue-sensitive emulsion would be associated with a yellow coupler. Other layers and addenda, such as antistatic compositions, subbing layers, surfactants, filter dyes, protective layers, barrier layers, development inhibiting releasing compounds, and the like can be present in photographic elements of the invention, as is well-known in the art. Detailed description of photographic elements and their various layers and addenda can be found in the above-identified *Research Disclosure* 17643 and in James, *The Theory of the Photographic Process.* 4th Ed., 1977.

Photographic elements suitable for use in accordance with this invention are disclosed in *Research Disclosure* 22534, January 1983, which is incorporated herein by reference. Further, the light sensitive elements disclosed in U.S. Pat. No. 4,980,267, fully incorporated herein by reference are useful in accordance with this invention.

The photographic element may include an antistatic agent, such as, alkali metal salts of styrene-maleic acid series copolymers and acrylonitrile-acrylic acid series copolymers, and antistatic agents as described in U.S. Pat. Nos. 3,206,312; 3,428,451; metal oxides, such as $V_2O_5$, $SnO_2$, $ZnO_2$, $TiO_2$, antimony doped $SnO_2$and the like. Suitable metal oxides are set forth in U.S. Pat. Nos. 4,203,769; 4,264,707; 4,275,103; 4,394,441; 4,495,276; 4,999,276 are incorporated herein by reference.

The invention is further illustrated by the following examples.

EXAMPLE 1

A polyethylene terephthalate (PET) base is coated with a multilayered color photographic emulsion. The dry thicknesses of the base and emulsion are 100 and 19 μm respectively (properties of said materials are listed in Table 1). The curl amplitude (CA) of said film is a measure of its susceptibility to change its curvature (curl) upon a change in relative humidity. CA is measured as follows: The film is first equilibrated at 50% RH (70° F.) and its curl measured using an ANSI curl gauge according to ANSI PH 1.29 (1985). The film is then exposed to 15% RH (70° F.) for two hours and its curl is measured. The curl amplitude is the difference between the curl values measured at these relative humidities:

$$CA = curl(15\%\ RH) - curl(50\%\ RH)$$

The curl amplitude of said film is 72 ANSI units.

EXAMPLE 2

The same emulsion as in Example 1 is coated on a coextruded film comprising 63.5 μm PET layer and 38 μm of a copolyester (MPET) resin made in accordance with Example 3 of U.S. Pat. No. 5,138,024 except that the copolyester contains 9.0 mol % of poly(ethyleneglycol) rather than 5 mol percent and 91 mol percent of ethyleneglycol rather than 95 mol percent. (Key properties of this resin are listed in Table 1). The emulsion layers are coated on the side of the PET layer of the coextruded base. The curl amplitude of this film is 6 ANSI units (see Table 2).

EXAMPLE 3

The same emulsion as in Example 1 is coated on an 89 μm PET base. The curl amplitude of said film is 74 ANSI units (see Table 2).

EXAMPLE 4

The same emulsion as in Example 1 is coated on a coextruded film comprising a PET layer, 63.5 μm thick, and a MPET (see Example 2) layer, 25 μm thick. The emulsion is coated on the side of the PET layer. The curl amplitude of this film is 11 ANSI units (see Table 2).

TABLE 1

| Material | IV (dl/g) | Material Properties % RH | Modulus ($10^5$) | HEC ($10^{-5}$ 1/% RH) | Poisson's ratio |
|---|---|---|---|---|---|
| Color emulsion | — | 15 | 3.5 | 13.0 | 0.3 |
| | | 30 | 3.5 | | |
| | | 50 | 2.8 | | |
| | | 80 | 0.5 | | |
| PET | 0.63 | 15 | 6.8 | 0.8 | 0.4 |
| | | 30 | 6.4 | | |
| | | 50 | 6.4 | | |
| | | 80 | 6.2 | | |
| MPET | 0.4 | 15 | 4.2 | 7.0 | 0.4 |
| | | 30 | 4.2 | | |
| | | 50 | 3.0 | | |
| | | 80 | 2.0 | | |

TABLE 2

| Example | Summary of Examples Thickness in μm Emulsion layer | PET layer | MPET layer | $h_2O$ | CA (ANSI units) |
|---|---|---|---|---|---|
| 1 | 19 | 100 | none | — | 72 |
| 2 | 19 | 63.5 | 38 | 37.5 | 6 |
| 3 | 19 | 89 | none | — | 74 |
| 4 | 19 | 63.5 | 25 | 37.5 | 11 |

This data is consistent with the values determined utilizing the formulas set forth above.

The multilayered color photographic emulsion layers employed in Examples 1 through 4 above are described as follows, layer 1, the blue sensitive layer being closest to layer 1 of the film support:

| | | Mg/ft² (1 mg/ft² = 0.001 mg/cm²) |
|---|---|---|
| Layer 1: | Blue-sensitive Layer | |
| | Emulsion (1) | |
| | Silver halide | 85 |
| | Gelatin | 316 |
| | Coupler-1 | 175 |
| | Dispersion Oil-2 | 44 |
| | Sensitizing Dye-1 | 0.131 |
| Layer 2: | Interlayer | |
| | Gelatin | 57 |
| Layer 3: | Red-Sensitive Layer | |
| | Emulsion (2) | |
| | Silver halide | 37 |
| | Gelatin | 262 |
| | Coupler-2 | 121 |
| | Dispersion Oil-1 | 10 |
| | Dispersion Oil-3 | 10 |
| | Sensitizing Dye-2 | 0.063 |
| Layer 4: | Interlayer | |
| | Gelatin | 57 |
| Layer 5: | Green-Sensitive Layer | |
| | Emulsion (3) | |
| | Silver halide | 56 |
| | Gelatin | 203 |
| | Coupler-3 | 65 |
| | Dispersion Oil-1 | 33 |
| | Sensitizing Dye-3 | 0.104 |
| Layer 6: | Protective Layer | |
| | Gelatin | 91 |
| | Hardener-1 | 1.6 |

The silver halide emulsions are prepared from an aqueous solution of gelatin. Sodium thiosulfate and chloroauric acid are added to the emulsions to perform chemical sensitization. The properties of the resultant emulsions are summarized in Table 3.

TABLE 3

| Emulsion | Silver Bromide (mol %) | Average Grain Size (μm) | Grain Shape | Weight Percent |
|---|---|---|---|---|
| (1) | 1.5 | 0.6 | cubic | 100 |
| (2) | 27 | 0.15 | cubic | 98 |
| | 27 | 0.25 | cubic | 2 |
| (3) | 26 | 0.15 | cubic | 94 |
| | 26 | 0.25 | cubic | 6 |

TABLE 4

| | |
|---|---|
| Dispersion Oil -1: | Tricresyl phosphate |
| Dispersion Oil -2: | Dibutyl phthalate |
| Dispersion Oil -3: | Di(tertiary amyl) phenol |
| Hardener -1: | Bisvinylsulfone methy ether |

Sensitizing dye-1:

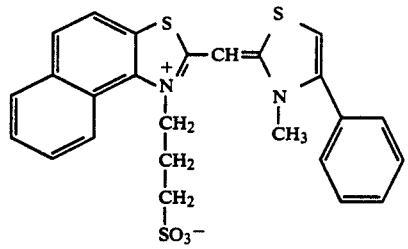

Sensitizing dye-2:

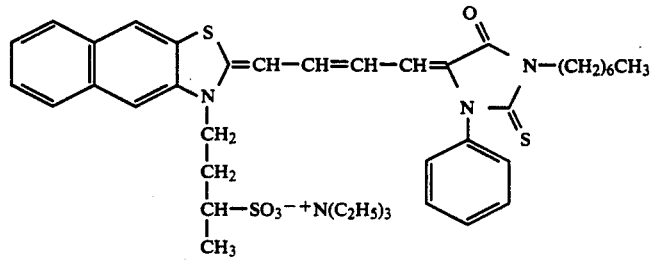

Sensitizing dye-3:

TABLE 4-continued

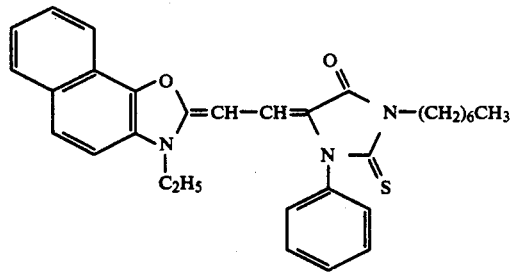

Coupler-1:

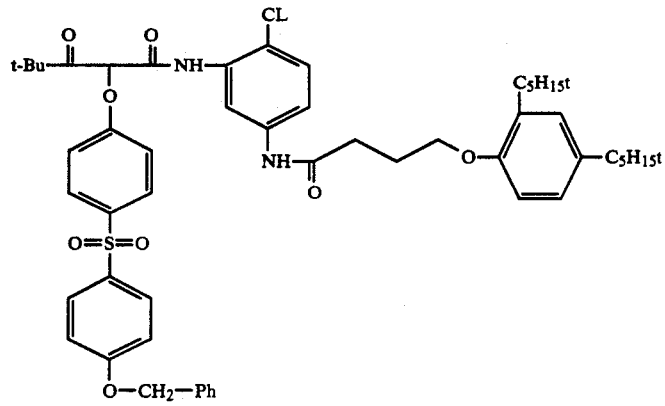

Coupler-2:

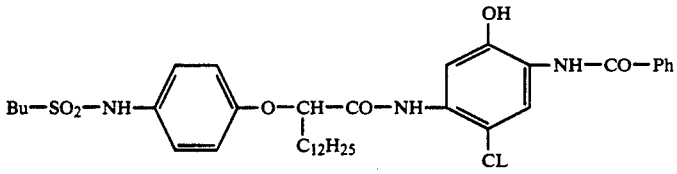

Coupler-3:

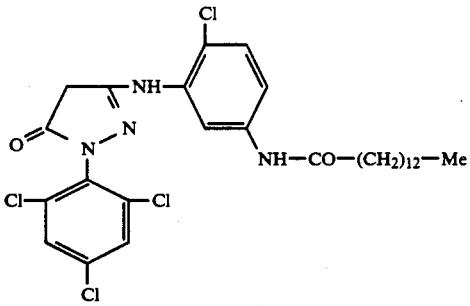

We claim:

1. A light-sensitive silver halide photographic element having at least one silver halide containing emulsion layer on a film base, the film base being a coextruded laminate having a first layer and a second layer, the first layer being a polyester of an aromatic dicarboxylic acid or a dialkyl ester thereof and an alkylene glycol adjacent to the emulsion layer, the second layer being a polyester having a humidity expansion coefficient greater than $5\times10^{-5}$ $$\frac{1}{\%\,RH},$$

(RH is relative humidity) and a Young's modulus at 50% relative humidity greater than 300 kPSI, the thickness of the second layer is defined by the formula;

$$0.3h_2^0<h_2<1.2h_2^0 \qquad \text{I}$$

where $h_2^0$ is the thickness of the second layer to obtain zero curl and is determined by formula $$h_2^0 = 0.5\left(-\frac{b}{a}+\sqrt{\left(\frac{b}{a}\right)^2-4\frac{c}{a}}\right) \qquad \text{II}$$

where the values a, b and c are obtained by the following formulas III, IV and V respectively;

$$a=\phi E'_2-E'_e h_e-E'_1 h_1 \quad \text{III}$$

$$b=\phi(h_e+h_1)E'_2+\phi h_1 E'_2-(h_e+h_1)h_e E'_e-h_1(E'_e h_e+E'_1 h_1) \quad \text{IV}$$

$$c=\phi(h_e+h_1)h_1 E'_1 \quad \text{V}$$

$\phi$ in the above formulas is determined by the following formula VI $$\phi=\frac{E'_e h_e(\alpha_e-\alpha_1)}{E'_2(\alpha_e-\alpha_2)} \quad \text{VI}$$

where $E'_e$, $E'_1$ and $E'_2$ are determined by the formula $$E'_i=\frac{E_i}{1-\nu_i^2} \quad \text{VII}$$

where i is layer 1, 2 or e respectively and $\nu_i$ is the Poisson's ratio of layer i (layer 1, 2 or e respectively) and where $h_e$, $E_e$ and $\alpha_e$ are the thickness, Young's modulus and HEC respectively of the emulsion layer;

$h_1$ $E_1$ and $\alpha_1$ are the thickness, Young's modulus and HEC respectively of the first layer of the film base; and $h_2$, $E_2$ and $\alpha_2$ are the thickness, Young's modulus and HEC respectively of the second layer of the film base.

2. The light sensitive element of claim 1 wherein $h_2$ is defined by the formula $$0.5h_2^0<h_2<h_2^0$$

3. The light sensitive element of claim 1 wherein the polyester of the first layer has a Young's modulus at 50% relative humidity of greater than 500 kPSI and a humidity of expansion coefficient less than $5\times10^{31}$ 5

$$\frac{1}{\%\,RH}.$$

4. The light sensitive element of claim 1 wherein layer 1 is a polyethylene terephthalate.

5. The light sensitive element of claim 1 wherein layer 1 is a polyethylene naphthalate.

6. The light sensitive element of claim 1 wherein layer 2 is a polyester of an aromatic dicarboxylic acid or dialkyl ester of an aromatic dicarboxylic acid, an alkylene glycol, a salt of a sulfonic acid-substituted aromatic dicarboxylate and a polyethylene glycol having a number average molecular weight of from 300 to 2000.

7. The light sensitive element of claim 6 wherein the aromatic dicarboxylic acid is terephthalic acid.

8. The light sensitive element of claim 6 wherein the aromatic dicarboxylic acid is naphthalene dicarboxylic acid.

9. The light sensitive element of claim 6 wherein the salt of a sulfonic acid-substituted aromatic dicarboxylate is 5-sodium sulfoisophthalic acid or dimethyl ester thereof.

* * * * *